United States Patent [19]

Riley

[11] 4,139,196

[45] Feb. 13, 1979

[54] DISTANCE GOLF CLUBS

[75] Inventor: Edward J. Riley, Pebble Beach, Calif.

[73] Assignee: The Pinseeker Corporation, Santa Ana, Calif.

[21] Appl. No.: 761,052

[22] Filed: Jan. 21, 1977

[51] Int. Cl.[2] ..... A63B 53/04

[52] U.S. Cl. ..... 273/164; 273/167 H; 273/167 G

[58] Field of Search ..... 273/77 R, 78, 80 C, 273/80.2, 164, 167–175, 183 D; D34/5 GS, 5 GH, 5 GC

[56] References Cited

U.S. PATENT DOCUMENTS

| | | | |
|---|---|---|---|
| 1,213,382 | 1/1917 | Kent | 273/174 X |
| 1,257,471 | 2/1918 | Fitzjohn et al. | 273/167 H X |
| 1,526,438 | 2/1925 | Scott | 273/174 X |
| 1,555,425 | 9/1925 | McKenzie | 273/167 E X |
| 1,582,836 | 4/1926 | Link | 273/167 H |
| 1,616,920 | 2/1927 | Pedersen | 273/174 X |
| 2,088,095 | 7/1937 | Sargent et al. | 273/77 R |
| 2,447,967 | 8/1948 | Stone | 273/167 F X |
| 2,846,228 | 8/1958 | Reach | 273/167 F X |
| 3,997,170 | 12/1976 | Goldberg | 273/164 |
| 4,027,885 | 6/1977 | Rogers | 273/167 F X |

FOREIGN PATENT DOCUMENTS

| | | | |
|---|---|---|---|
| 258723 | 9/1926 | United Kingdom | 273/174 |
| 397252 | 8/1933 | United Kingdom | 273/167 F X |
| 679292 | 9/1952 | United Kingdom | 273/167 H X |

*Primary Examiner*—Richard J. Apley
*Attorney, Agent, or Firm*—Jack M. Wiseman

[57] ABSTRACT

A distance golf club for hitting a golf ball a distance generally designated for golf clubs using wooden heads and under conditions where the golf clubs using wooden heads are generally used. The golf club comprises a shaft, a club head and a hosel integrally formed with the club head for fixedly receiving an end of the shaft to secure the end of the shaft to the club head in alignment with the face of the club head. The club head is formed from a hollow steel casting and has either a metallic sole plate or an epoxy sole plate, dependent on whether the distance club is either a driver or one of the other distance clubs.

14 Claims, 11 Drawing Figures

Fig_8
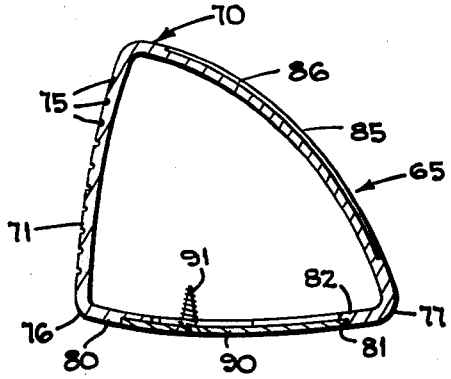
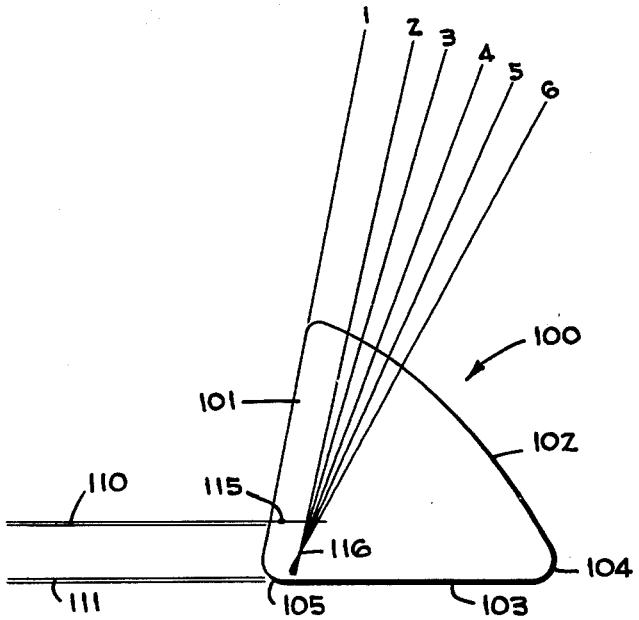
Fig_9

DISTANCE GOLF CLUBS

BACKGROUND OF THE INVENTION

The present invention relates in general to golf clubs, and more particularly to a golf club for hitting a golf ball a distance generally designated for a wood club and for hitting a golf ball under conditions where wood clubs are generally utilized for the respective positions of the ball. Heretofore, wood clubs have had the club head thereof streamlined to reduce the bulky shape thereof. Attempts have been made to relocate the shaft of the wood club into alignment with the face of the club head. Additionally, inserts of various materials have been employed in the wood club head for improved control over a golf ball when hit by the wood club head. Such attempts to increase the control and travel of a golf ball when hit by a wood club and to align the end of the shaft secured by the hosel with the face of the club head have not been totally satisfactory because of weight problems and because the golf club became less durable.

It has been found that the club head of a wood golf club is subject to distortion, weight variations, moisture absorption and the like from inclement weather conditions. Such distortion may be observed at the face of the club head and at the location of the hosel with respect to the face of the club head.

Patents of interest are the patent to Belmont U.S. Pat. No. 3,979,123, for Golf Club Heads And Process, and the patent to Jepson et al. U.S. Pat. No. 3,985,363, for Golf Club Wood.

SUMMARY OF THE INVENTION

A distance golf club comprising a shaft and a club head. Integrally formed with the club head is a hosel that receives one end of the shaft for securing the club head to the shaft. The club head is made of metal and is hollow. A sole plate for the club head may be either metallic, such as aluminum, or may be a plastic, such as an epoxy.

A feature of the present invention is that the hosel is aligned with the face of the club head for improved accuracy, lift and flight.

An object of the present invention is to provide a distance golf club for hitting a golf ball a distance generally designated for wood clubs in which the wind resistance of the club head is reduced.

An object of the present invention is to provide a distance golf club for hitting a golf ball a distance generally designated for wood clubs in which the aerodynamic characteristics of the club head are improved without sacrificing the durability of the golf club.

Another object of the present invention is to provide a distance golf club for hitting a golf ball a distance generally designated for wood clubs in which the weight of the club head is reduced without sacrificing either the durability of the golf club or the aerodynamic characteristics of the club head.

Another object of the present invention is to provide a distance golf club for hitting a golf ball a distance generally designated for wood clubs in which the club head is not subject either to distortion, weight variations, moisture absorption or the like from inclement weather conditions.

A feature of the present invention is that a distance golf club for hitting a golf ball a distance generally designated for wood clubs now has the end of the shaft secured to the hosel in alignment with the face of the club head and the club head has improved aerodynamic characteristics to reduce wind resistance.

Another feature of the present invention is that a distance golf club for hitting a golf ball a distance generally designated for wood clubs has the end of the shaft fixed to the hosel aligned with the face of the club head as distinguished from a position behind the club face for improved accuracy, lift and flight of the golf ball.

Another feature of the present invention is to provide a distance golf club for hitting a golf ball a distance generally designated for wood clubs in which the face of the club head has a larger area for easy playability.

Another feature of the present invention is to provide a distance golf club for hitting a golf ball a distance designated for wood clubs in which alignment aids in the form of parallel indicia is formed on a top surface of the club head disposed in the direction of the desired line of flight for facilitating the alignment of the club head with the ball.

Another feature of the present invention is to provide a distance golf club for hitting a golf ball a distance generally designated for wood clubs in which the flight distance, accuracy of flight, and ball control are improved. All shots to the green involving difficult lies will be easier to perform because of the sole member and contour of the club head.

Another feature of the present invention is to provide a distance golf club for hitting a golf ball a distance generally designated for wood clubs in which the club head requires less refinishing; in which the club head does not vary in weight because of climatic conditions, such as the presence of moisture; and in which the performance is improved.

DESCRIPTION OF THE DRAWINGS

FIG. 8 is a vertical section view taken along line 8—8 of FIG. 5.

FIG. 9 is a diagrammatic illustration of the location of center lines for shaft alignment to club heads for the various distance clubs embodying the present invention.

DETAILED DESCRIPTION OF THE PREFERRED EMBODIMENTS

A distance golf club as herein employed means a golf club for hitting a golf ball a distance generally designated for a golf club with a wooden head and for hitting a golf ball under conditions generally used by a golf club with a wooden head. Men distance golf clubs have been designated Nos. 1, 2, 3, 4, 5, and 6 clubs. Women distance clubs have been designated Nos. 1, 3, 4 and 5 clubs. Illustrated herein in FIGS. 5–8 is a distance golf club designated as a number 1 club, commonly referred to as a driver. Illustrated herein in FIGS. 1–4 is a distance golf club commonly designated as a number 4 club.

Figure 1:
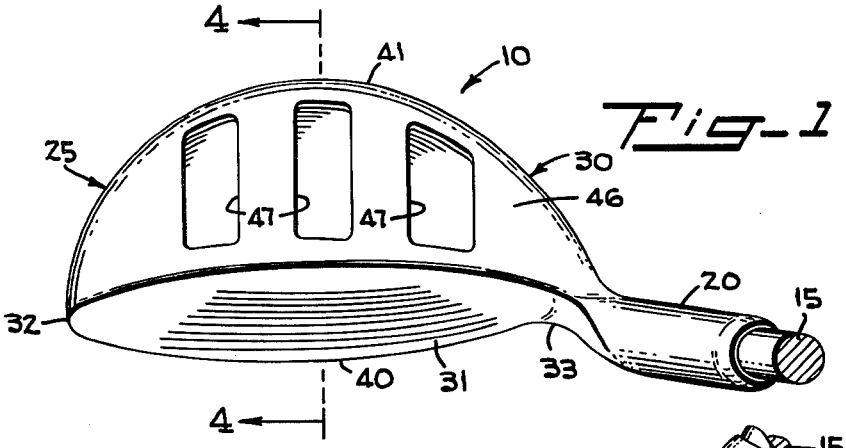
FIG. 1 is a plan view of a distance golf club embodying the present invention with the shaft thereof broken away.
Figure 2:
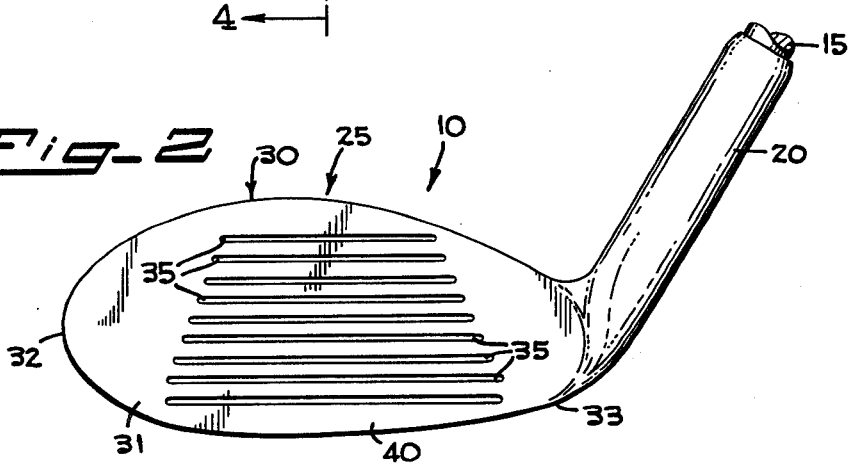
FIG. 2 is a front elevation view of the distance golf club shown in FIG. 1 with the shaft thereof broken away.
Figure 3:
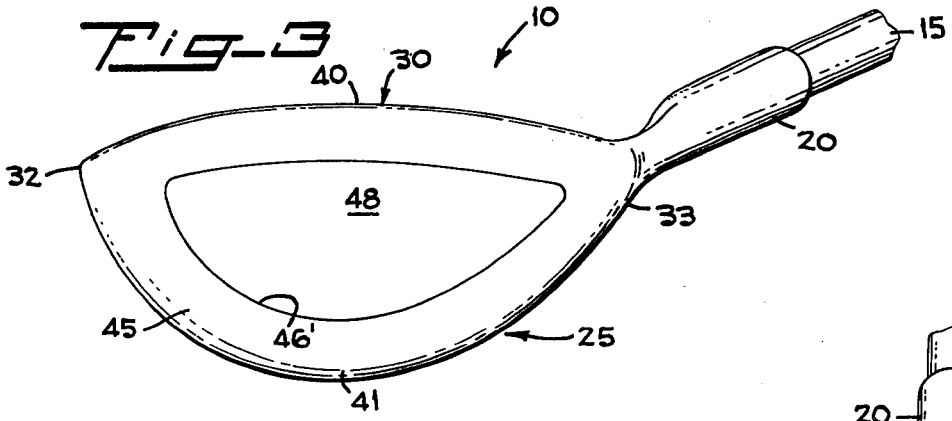
FIG. 3 is a bottom view of the distance golf club shown in FIGS. 1 and 2 with the shaft thereof broken away.

Illustrated in FIGS. 1–3 is a distance golf club 10 comprising a conventional shaft 15. In the exemplary embodiment, the shaft 15 is a True Temper steel shaft. One end of the shaft 15 is received in fixed relation in a conventional manner by a hosel 20 of a club head 25. The hosel 20 is integrally formed with the club head 25.

According to the present invention, the club head 25 comprises a one-piece, hollow steel body 30. In the preferred embodiment, the unitary hollow body 30 is made of 17-4 stainless steel.

The hollow body 30 comprises a face 31 to provide a golf ball striking surface for the club head 25. Reference numeral 32 designates generally the toe portion of the club head 25 and the reference numeral 33 designates generally the heel portion of the club head 25. Formed in the face 31 are parallel grooves 35 of the hitting area which extend in the heel-to-toe direction of the club head 25 for improving the ball-striking surface of the face 31. The face 31 has a slightly convex configuration in the heel-to-toe direction. From top to bottom of the club head 25, the face 31 is very slightly convex in configuration.

Figure 3A:
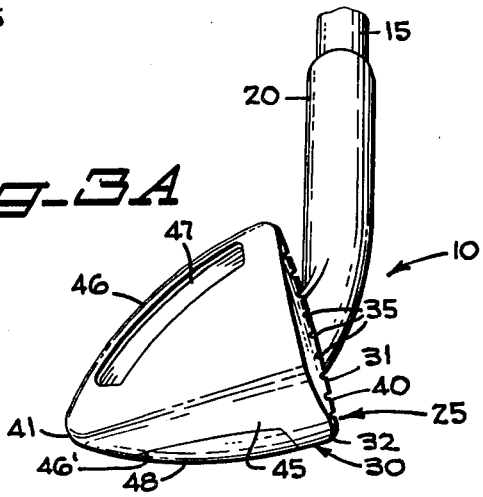
FIG. 3A is an end elevation view of the distance golf club shown in FIGS. 1–3 with the shaft broken away.
Figure 5:
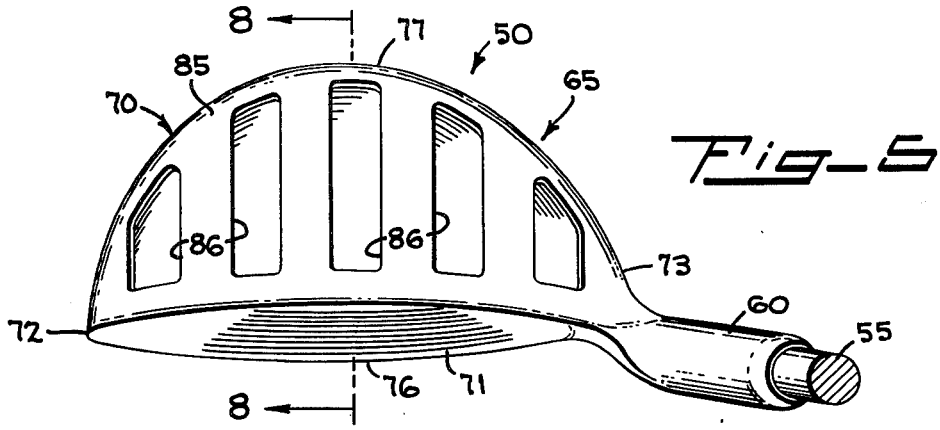
FIG. 5 is a plan view of a distance golf club embodying the present invention with the shaft thereof broken away, which is a modification of the distance golf club shown in FIGS. 1–4.
Figure 6:
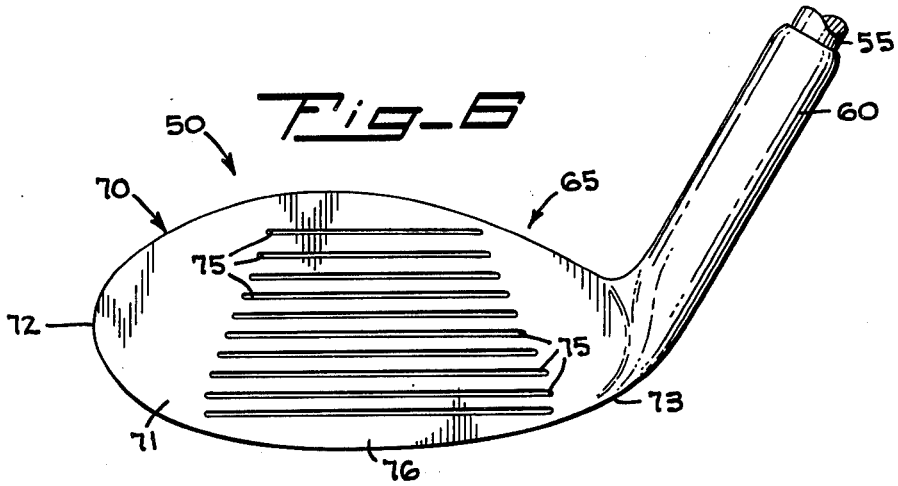
FIG. 6 is a front elevation view of the distance golf club shown in FIG. 5 with the shaft thereof broken away.

The hosel 20 and, therefore, the lower end of the shaft 15 is disposed in alignment with the face 31 of the club head 25. More specifically, the coincident axes of the hosel 20 and the lower end of the shaft 25 are disposed substantially in a plane passing along an exposed surface of the face 31 (FIG. 3A).

The fore portion of the club head 25 is shown by the reference numeral 40 and the aft portion of the club head 25 is shown by the reference numeral 41. Extending from the lowermost portion of the face 31 in the aft direction is a bottom wall 45. Formed in the bottom wall 45 is an opening 46' defined by conjoined arcuate surfaces. The arcuate surface of the bottom wall 45 at the aft portion 41 has a greater curve than the arcuate surface at the fore portion 40. The arcuate surfaces of the bottom wall 45 extend from heel to toe of the club head 25.

For providing improved aerodynamic characteristics for the club head 25, the hollow body 30 includes a top wall 46. The top wall 46 joins the bottom wall 45 approximately midway between the top and bottom of the face 31 in an arcuate surface extending from the heel to toe of the club head 25. From the bottom wall 45, the top wall 46 has a smooth, gradual, upwardly curved surface from aft to fore of the club head 25 joining the uppermost portion of the face 31 in an arcuate surface extending from the heel to toe of the club head 25.

Formed in the top wall 46 are parallel recessed sections 47, which extend from fore to aft to provide visual aids for the alignment of the line of flight of a golf ball to aid in addressing the golf ball.

To form a sole member 48 for the club head 25, a solid plastic core 49 (FIG. 4), such as a cast epoxy resin, is disposed in the hollow steel body 30 of the club head 25. The exposed surface of the core 49 and thus the sole member 48 is slightly convex and is coterminous with the bottom wall 45 surrounding the exposed surfaces thereof.

Illustrated in FIGS. 5–8 is a distance golf club 50, which is a modification of the distance golf club 10. The distance golf club 50 comprises a conventional shaft 55. In the exemplary embodiment, the shaft 55 is a True Temper steel shaft. One end of the shaft 55 is received in fixed relation in a conventional manner by a hosel 60 of a club head 65. The hosel 60 is integrally formed with the club head 65. The club head 65 is larger in fore-to-aft dimension than the club head 25. It is larger in heel-to-toe dimension than the club head 25 and is also larger in the top-to-bottom dimension than the club head 25.

According to the present invention, the club head 65 comprises a one-piece hollow steel body 70. In the preferred embodiment, the unitary hollow body 70 is made of 17-4 stainless steel.

The hollow body 70 comprises a face 71 to provide a golf ball striking surface for the club head 65. The face 71 is greater in dimension than the face 31 in both the heel-to-toe direction and in the top-to-bottom direction to provide a larger striking area for the club head 65. Reference numeral 72 designates generally the toe portion of the club head 65 and the reference numeral 73 designates generally the heel portion of the club head 65. Formed in the face 71 are parallel grooves 75 extending from heel-to-toe of the club head 65 for improving the ball striking surface of the face 71. The face 71 has a slightly convex configuration in the heel-to-toe direction. From top-to-bottom of the club head 65, the face 71 is very slightly convex in configuration.

Figure 7:
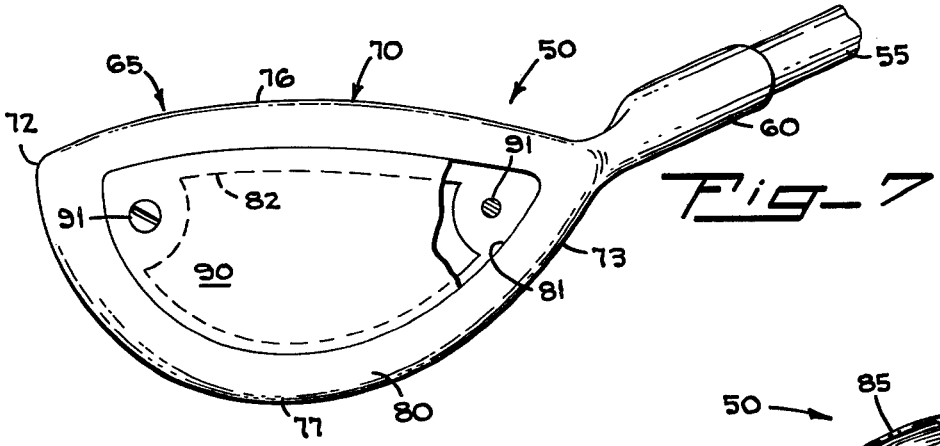
FIG. 7 is a bottom view of the distance golf club shown in FIGS. 5 and 6.
Figure 7A:
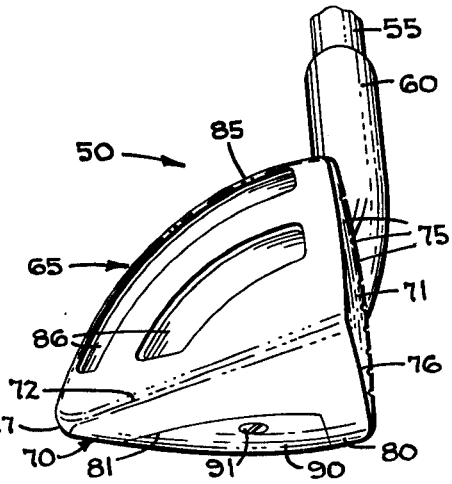
FIG. 7A is an end elevation view of the distance golf club shown in FIGS. 5–7 with the shaft thereof broken away.

The hosel 60 and, therefore, the lower end of the shaft 55 is disposed in alignment with the face 71. More specifically, the coincident axes of the hosel 60 and the lower end of the shaft 55 are disposed substantially in a plane passing along an exposed surface of the face 71 (FIG. 7A).

The fore portion of the club head 65 is shown by the reference numeral 76 and the aft portion of the club head is shown by the reference numeral 77. Extending from the lowermost portion of the face 71 in the aft direction is a bottom wall 80. Formed in the bottom wall 80 is an opening 81. Surrounding the opening 81 is a recessed flange 82 for the bottom wall 80. The bottom wall 80 includes conjoined arcuate surfaces. The arcuate surfaces of the bottom wall 80 at the aft portion 77 has a greater curve than the arcuate surface at the fore portion 76. The arcuate surfaces of the bottom wall 45 extend from heel-to-toe of the club head 65.

For providing improved aerodynamic characteristics for the club head 65, the hollow body 70 includes a top wall 85. The top wall 85 joins the bottom wall 80 approximately midway between the top and bottom of the face 71 in an arcuate surface extending from the heel to the toe of the club head 65. From the bottom wall 80, the top wall 85 has a smooth, gradual upwardly curved surface from aft to fore of the club head 65 joining the uppermost portion of the face 71 in an arcuate surface extending from the heel-to-toe of the club head 65.

Formed in the top wall 85 are parallel recessed sections 86, which extend from fore-to-aft to provide visual aids for the alignment of the line of flight of a golf ball to aid in addressing the golf ball and for visualizing the takeoff flight of the golf ball.

To form a sole member for the club head 65, an aluminum plate 90 is secured to the recessed flange 82 by suitable means, such as screws 91. The sole plate 90 is slightly convex and is coterminous with the lowermost surfaces of the bottom wall 80 (FIG. 8).

Distance golf clubs Nos. 2, 3, 5 and 6 are similar to the distance golf club 10 (FIGS. 1–4), the differences being in the loft and in the fore-to-aft, top-to-bottom, and toe-to-heel dimensions of the club head. As the number of the club increases, the dimensions decrease and the loft increases. The loft is varied by changing the acute angle of the face of the club head relative to the sole member. By virtue of the present invention, a set of distance golf clubs is attainable with precise specifications so that, from the No. 1 club through the No. 6 club, the clubs of the set are reduced dimensions of the No. 1 club without varying the design uniqueness of each club. Stated otherwise, each club of the set is produced from one master pod. Additionally, the axis of the hosel and the axis of the end of the shaft received by the hosel are always disposed in a plane passing through an exposed surface of the face of the club head for improved accuracy, lift and carry of the golf ball.

Figure 4:
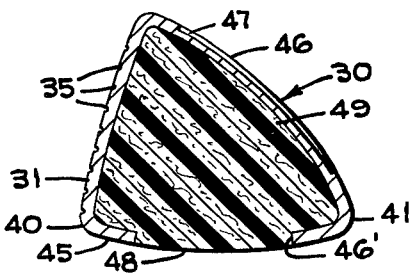
FIG. 4 is a vertical section view taken along 4—4 of FIG. 1.

Illustrated in FIG. 9 is a diagrammatic illustration of a gold club embodying the present invention in which a club head 100 is shown in cross-section, such as in FIGS. 4 and 8. Therefore, reference numeral 101 represents the face of the club head 100; reference numeral 102 represents the top wall of the club head 100; and the reference numeral 103 represents the sole member and bottom wall of the club head 100. The aft portion of the club head 100 is represented by the reference numeral 104, and the fore portion of the club head is represented by the reference numeral 105. The top wall 102 starts from the aft extremity of the club head 100 and progresses up to the No. 1 distance club. Distance clubs 2, 3, 4, 5 and 6 are formed at a precise desired angle respectively within the top wall projection 102 as designated by the numbers 2, 3, 4, 5 and 6, respectively.

A hosel is designated by a reference numeral 110 and a shaft is designated by a reference numeral 111. In the exemplary embodiment, the diameter of the hosel 110 for all distance clubs is 0.475 inches, and the diameter of the shaft 111 at the end thereof received by the hosel 110 is 0.375 inches. The hosel length measured from the heel of each distance club is 2.75 inches in the exemplary embodiment. The center line of the hosel 110 and the shaft 111 is disposed behind the face touch point of the club head 100 a distance of 0.62 inches toward the aft portion 104, in the exemplary embodiment. In the distance club 50 (FIGS. 5–8), the dimension of the bottom wall, such as shown by the reference numeral 103 in FIG. 9, is 2 inches, in the exemplary embodiment. The alignment spot 115 for the distance club 50 (FIGS. 5–8) is shown at reference numeral 115. The alignment spots for the clubs 2, 3, 4, 5 and 6 are taken relative thereto. The loft angles, in the exemplary embodiment, are as follows:

No. 1 Distance Club — 11°
No. 2 Distance Club — 13½°
No. 3 Distance Club — 16°
No. 4 Distance Club — 20°
No. 5 Distance Club — 24°
No. 6 Distance Club — 28°

In the Nos. 2, 3, 4, 5 and 6, the angle for the face of the club head, in the exemplary embodiment, is taken at a point 116, which in the exemplary embodiment is located 1.80 inches from the extremity of the aft portion 104. All heads are produced by use from within the No. 1 master shell. The shell embodies a constant sole and the silouette curve to the high point of the club head, as shown in FIG. 9.

In the method of manufacturing the distance clubs of the present invention, it is preferable to use an investment cast method for producing a matched set of distance clubs from stainless steel. Toward this end, the club head body, such as 30 and 70, and hosel, such as 20 and 60, is first cast in wax. The full face plate, such as 31 and 71, is then cast as a separate unit in wax. The face plate is then wax-welded into position on a wax club head body to form a unitary unit. The wax unitary unit is then cast by the lost wax process to produce a unitary, hollow, steel club head body, such as 30 and 70, with a hosel, such as 20 and 60. Then, the sole member, such as 48 and 90, is formed in or mounted on the club head body in a manner previously described. Lastly, the shaft, such as 15 and 55, is fixedly secured in the hosel in a conventional manner.

The use of steel with its much greater structural strength allows the distance club heads of the present invention with their integral hosel to be designed according to aerodynamic and functional principles. Additionally, the distance club heads of the present invention are improved aerodynamically by contouring the top and bottom surfaces. This aerodynamically improved form of distance club head reduces wind resistance and increases the club head speed and the carry of the golf ball. The contoured bottom surface also enables the player to hit golf balls from more difficult lies than was previously possible. The use of steel allows the shafts of all the club heads in a set to be perfectly and permanently aligned with the face. The shaft alignment serves to improve accuracy, lift and carry to the golf ball.

The alignment slots on the top surface of the club head are parallel to the line of flight and enable the player to improve the address. These alignment slots are a permanent feature of the club head, since they are built into the structure of the club head.

The distance club heads of the present invention are manufactured from steel or one of its alloys, preferably stainless steel. The club heads have been produced by investment casting a 17-4 stainless steel alloy (17% chrome, 4% nickel) with the lost wax technique. If a nonstainless alloy is employed, the exterior surface of the club head may be protected by one or more conventional techniques, such as anodizing, chemical coating, plating, etc.

The solid, polymeric resin core 49 disposed within the hollow steel shell (FIGS. 1–4) may be produced from a castable polymeric resin, preferably an epoxy resin.

Conventional golf club shafts, such as True Temper steel shafts, graphite shafts, fiberglass shafts, or the like, may be employed. The shafts are attached to the club head using conventional techniques in the same manner as shafts are attached to iron club heads.

The distance club heads of the present invention are more durable than conventional wood golf club heads. Since they do not require paint or varnish to protect the club head from moisture-induced changes in form, they do not require periodic refinishing to maintain consistent playing characteristics. The club heads do not require head covers. The club heads will not wear out or crack, or require replacement of broken inserts. They will not gain or lose weight or change alignment between face and/or hosel and/or shaft due to climatic conditions, as they do not absorb moisture.

I claim:

1. A distance golf club comprising:
(A) a hosel;
(B) a shaft having the lower end thereof received by said hosel in fixed relation; and
(C) a club head fixed to said hosel for movement therewith, said club head comprising:
(a) a hollow steel body having a face for striking the ball and a top wall; and
(b) a sole member extending along the bottom of said hollow body between said face and said top wall,
(c) said hollow body having a bottom wall surrounding said sole member and having a plastic core therein disposed on said bottom wall,
(d) said top wall having a smooth, gradually exposed curved surface extending between the upper portion of said face and said bottom wall to provide improved aerodynamic characteristics for said club head.

2. A distance golf club as claimed in claim 1 wherein said steel is of stainless steel.

3. A distance golf club as claimed in claim 2 wherein said hosel has a center line that is disposed in alignment with a plane passing through an exposed surface of said face.

4. A distance golf club as claimed in claim 2 wherein said core of plastic forms said sole member.

5. A distance golf club as claimed in claim 1 wherein said steel is a 17-4 stainless steel.

6. A distance golf club as claimed in claim 5 wherein said hosel has a center line that is disposed in alignment with a plane passing through an exposed surface of said face.

7. A distance golf club as claimed in claim 6 wherein said core of plastic forms said sole member.

8. A distance golf club as claimed in claim 1 wherein said hosel has a center line that is disposed in alignment with a plane passing through an exposed surface of said face.

9. A distance golf club as claimed in claim 1 wherein said core of plastic forms said sole member.

10. A distance golf club as claimed in claim 1 wherein said top wall is formed with means on the exposed surface thereof disposed in the fore-to-aft direction of said club head to provide visual indicia for addressing a golf ball.

11. A distance golf club as claimed in claim 1 wherein said hollow body and said hosel is a unitary structure.

12. A distance golf club comprising:
(A) a hosel;
(B) a shaft having the lower end thereof received by said hosel in fixed relation; and
(C) a club head fixed to said hosel for movement therewith, said club head comprising:
(a) a hollow steel body having a face for striking the ball and a top wall, said hollow steel body being made of a 17–4 stainless steel, and
(b) a sole member extending along the bottom of said hollow steel body between said face and said top wall,
(c) said hollow steel body having a bottom wall surrounding said sole member and having a plastic core therein disposed on said bottom wall,
(d) said hosel having a center line disposed in alignment with a plane passing through an exposed surface of said face,
(e) said top wall having a smooth, gradually exposed curved surface extending between the upper portion of said face and said bottom wall to provide improved aerodynamic characteristics for said club head.

13. A distance golf club as claimed in claim 12 wherein said top wall is formed with means on the exposed surface thereof disposed from in the fore-to-aft direction of said club head to provide visual indicia for addressing a golf ball.

14. A distance golf club as claimed in claim 13 wherein said hollow body, said bottom wall and said hosel is a unitary structure.

* * * * *